US005252935A

United States Patent [19]

Yamamoto et al.

[11] Patent Number: 5,252,935

[45] Date of Patent: Oct. 12, 1993

[54] ELECTROMAGNETIC SWITCH

[75] Inventors: Kyohei Yamamoto; Katunori Yagi, both of Himeji, Japan

[73] Assignee: Mitsubishi Denki Kabushiki Kaisha, Tokyo, Japan

[21] Appl. No.: 991,272

[22] Filed: Dec. 16, 1992

[30] Foreign Application Priority Data

Jan. 31, 1992 [JP] Japan ..... 4-045899

[51] Int. Cl.[5] ..... H01H 67/02

[52] U.S. Cl. ..... 335/126; 335/131

[58] Field of Search ..... 335/126, 131, 255, 202; 336/192

[56] References Cited

U.S. PATENT DOCUMENTS 4,293,835 10/1981 Davis et al. ..... 335/131

FOREIGN PATENT DOCUMENTS 1-30770 1/1989 Japan .

*Primary Examiner*—Lincoln Donovan

*Attorney, Agent, or Firm*—Sughrue, Mion, Zinn, Macpeak and Seas

[57] ABSTRACT

An electromagnetic switch comprising: an excitation coil wound around a bobbin made of a synthetic resin material; a yoke accommodating said excitation coil; a fixed core fixed inside of a first end side of said yoke; a magnetic path plate contacting an outer end of a flange at a second end side opposite to said first end side of said bobbin and fixed inside of said second end side of the yoke; a bush made of a nonmagnetic material and fixed in an inner periphery of the bobbin; a movable core movably supported in said bush in the axial direction thereof; and terminal means closed by urging to press said terminal means by a magnetic suction of said movable core to said fixed core; wherein a plurality of arms are extended in the axial direction from an inner peripheral portion of the bobbin at the second end side thereof; a receiving portion is formed at end portions of said respective arms integrally therewith; cut-off portions are provided for passing the respective arms therethrough at an inner peripheral portion of said magnetic path plate; and the retracted movable core is received by an inner end face of said receiving portion.

1 Claim, 3 Drawing Sheets

ELECTROMAGNETIC SWITCH

BACKGROUND OF THE INVENTION

1. Field of the Invention

This invention relates to an electromagnetic switch for opening and closing a circuit such as an excitation coil of an electromagnetic switch of a starter motor of an internal combustion engine.

2. Discussion of Background

Electromagnetic switches are employed in opening and closing an excitation circuit of an electromagnetic switch of a starter motor, a glow relay of a heater circuit of a glow plug of a Diesel car or the like.

FIG. 5A is a longitudinal sectional diagram of a conventional electromagnetic switch disclosed for instance, in Japanese Utility Model Publication No. 30770/1989. In FIG. 5A, a reference numeral 1 designates a yoke composing a case, 2, an excitation coil wound around a bobbin made of a synthetic resin material, and 4, a disk body made of a magnetic material contacting an end portion of the yoke 1, composing a fixed core 6 along with a cylindrical body 5 made of a magnetic material and fixed to an inner peripheral portion thereof. A numeral 7 designates a magnetic path plate made of a magnetic material and fixed between other end portion of the yoke 1 and a flange 3*a* on the other side the bobbin 3, and 8, a bush made of a nonmagnetic material fitted into an inner periphery of the bobbin 3, at an outer end portion of which three protrusions 8*a* protruding inwardly are formed by pressing. A numeral 9 designates a movable core movably supported by an inner periphery of the bush 8 in the axial direction, forming a plunger, which usually is received by the protrusions 8*a* in retracting thereof. A numeral 10 designates a movable terminal axle made of a synthetic resin material, at which front end side a movable terminal 11 is fitted and which is received by a stop ring 12 and is pressed by a terminal pressing spring 13. A numeral 14 designates a spring for retracting which retracts the movable terminal axle 10 and the movable core 9 contacting thereto. A numeral 15 designates an insulation cap made of a synthetic resin material covering up the terminal portion, which is attached to an end portion of the yoke 1 by screws (not shown) along with a packing 16 made of a gummy material and the disk body 4. A numeral 17 designates a pair of fixed terminals fixed to the insulation cap 15, opposing the movable terminal 11. A terminal bolt 18 which is integrally formed with the fixed terminal is outwardly extended therefrom. A numeral 19 designates a terminal connected with a lead wire 2*a* from the excitation coil and 20, an attaching band.

FIG. 5B is a sectional diagram taken alone a $B_5$—$B_5$ of FIG. 5A. The magnetic path plate 7 is fixed to the outer periphery of the bush 8 and the retracted movable core 9 is received by the protrusions 8*a* of the bush 8.

Next, explanation will be given to the operation. When current flows in the excitation coil 2, the movable core 9 is sucked by the fixed core 6. The movable terminal axle 10 is forwarded thereby, the movable terminal 11 closes the fixed terminals 17 and a circuit connected to the terminal bolt 18 is closed.

In the conventional electromagnetic switch, the retracted movable core 9 is received by the protrusions 8*a* of the bush 8 by contacting thereto, and a metallic impact sound is generated which is offensive to ears. Furthermore, the movable core 9 is pressingly received by internal ends of the thin-walled protrusions 8*a* in a small contact area, wear on both contact surfaces thereof is promoted by a repetitive action thereof and the function thereof is hampered. Furthermore, with respect to the forming of a plurality of protrusions 8*a* on the thin-walled cylindrical bush 8 by pressing, the fabrication thereof is difficult.

SUMMARY OF THE INVENTION

It is an object of the present invention to solve the above problem and to provide an electromagnetic switch which reduces the receiving-contact sound caused by the retraction of the movable core, dispenses with the wear generated by the receiving-contact and facilitates the fabrication of the receiving portion.

According to an aspect of the present invention, there is provided an electromagnetic switch comprising:

an excitation coil wound around a bobbin made of a synthetic resin material;

a yoke accommodating said excitation coil;

a fixed core fixed inside of a first end side of said yoke;

a magnetic path plate contacting an outer end of a flange at a second end side opposite to said first end side of said bobbin and fixed inside of said second end side of the yoke;

a bush made of a nonmagnetic material and fixed in an inner periphery of the bobbin;

a movable core movably supported in said bush in the axial direction thereof; and terminal means closed by urging to press said terminal means by a magnetic suction of said movable core to said fixed core; wherein a plurality of arms are extended in the axial direction from an inner peripheral portion of the bobbin at the second end side thereof;

a receiving portion is formed at end portions of said respective arms integrally therewith;

cut-off portions are provided for passing the respective arms therethrough at an inner peripheral portion of said magnetic path plate; and the retracted movable core is received by an inner end face of said receiving portion.

In this invention, the respective arms of the bobbin made of a synthetic resin material pass through the cut-off portions of the magnetic path plate. When the movable core is retracted, it is received by the inner end of the receiving portion of the end of the bobbin, thereby reducing the contact sound. Furthermore, since the contact area of the receiving portion is large, the wear is dispensed with. The forming of the receiving portion of the end of the bobbin is performed by the integral forming employing a mold, which facilitates the manufacturing.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 1A, 1B and 1C illustrate a first embodiment of an electromagnetic switch according to the present invention, wherein FIG. 1A is a longitudinal sectional diagram thereof, FIG. 1B, a sectional diagram taken along a line $B_1$—$B_1$ of FIG. 1A and FIG. 1C, a front view of a magnetic path plate in FIG. 1A;

DETAILED DESCRIPTION OF THE PREFERRED EMBODIMENTS

Example 1

Figure 1A:
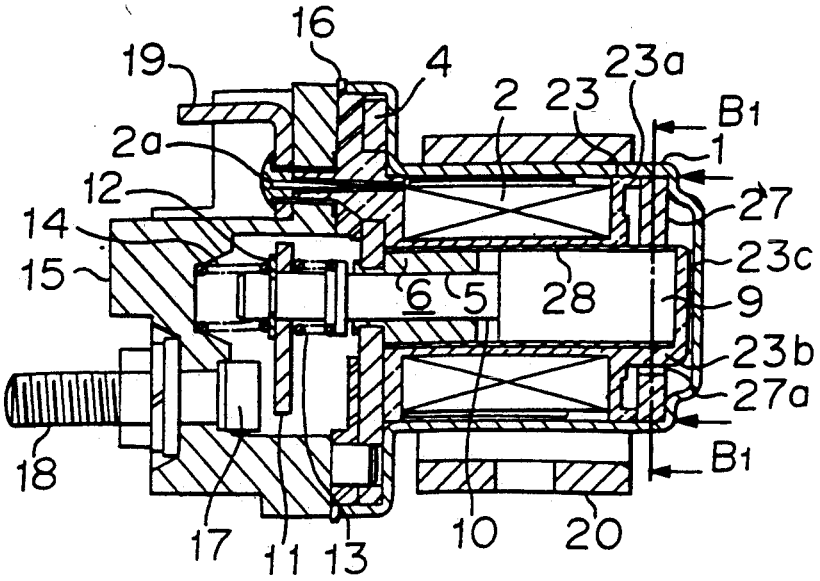
Figure 1B:
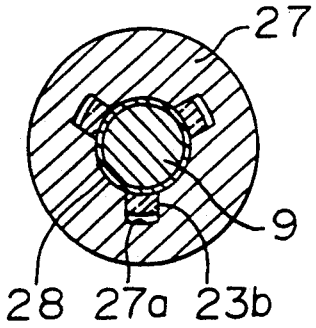
Figure 1C:
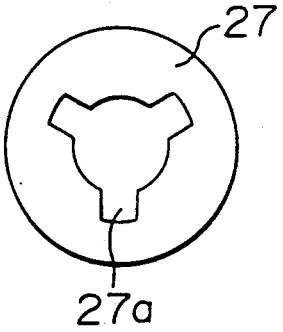
Figure 2:
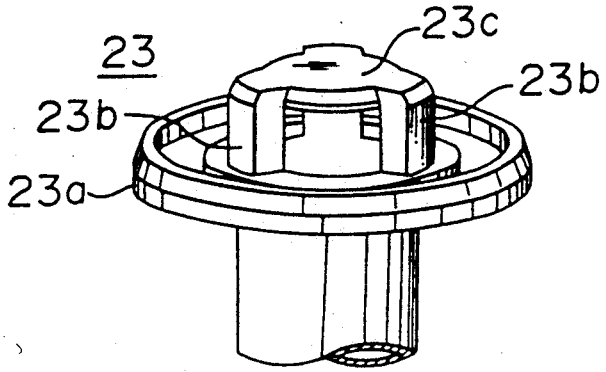
FIG. 2 is a perspective view of a bobbin of FIG. 1A at its other end side.
Figure 5A:
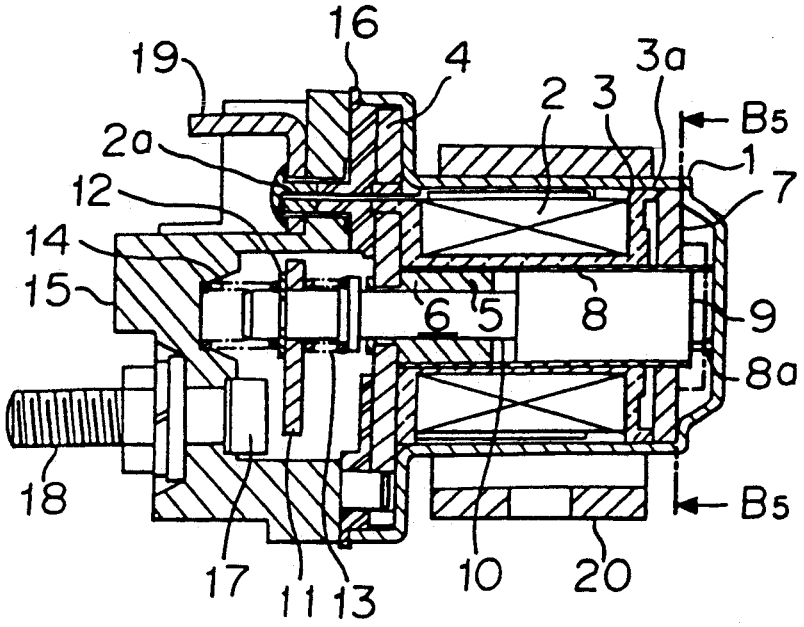
FIGURE 5 A PRIOR ART
FIGS. 5A and 5B illustrate a conventional electromagnetic switch wherein FIG. 5A designates a longitudinal sectional diagram thereof and FIG. 5B, a sectional diagram taken along a line $B_5$—$B_5$ of FIG. 5A.
Figure 5B:
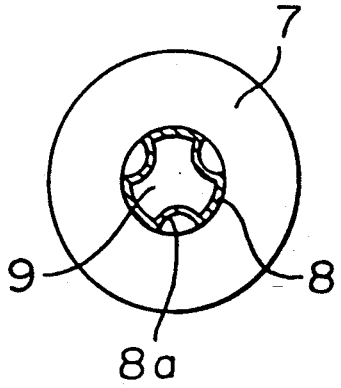
FIGURE 5 B PRIOR ART

FIG. 1A is a longitudinal sectional diagram of an embodiment of an electromagnetic switch according to the present invention, wherein notations 1, 2, 2*a*, 4 through 6, and 9 through 20 are the same with those in FIGS. 5A and 5B. A plurality (3 in FIG. 1A) of thick-walled arms 23*b* are extended in the axial direction, from an inner peripheral portion at other end portion of a bobbin 23 made of a synthetic resin material and wound with the excitation coil 2, at the respective end portions of which, a circular receiving portion 23*c* is formed integrally with the arms 23*b*. The perspective diagram of the other end side of the bobbin 23 is shown in FIG. 2. Now, back to FIG. 1A, a thin-walled bush 28 made of a nonmagnetic material is fixed to the inner periphery of the bobbin 23, movably supporting the movable core 9 in the axial direction. A numeral 27 designates a circular magnetic path plate contacting the outer end of a flange 23*a* on the other side of the bobbin 23, and fixed to a back internal end of the yoke 1, of which inner periphery is fixed to the outer periphery of the bush 28, and through cut-off portions 27*a* of which, the respective arms 23*b* pass. A section taken along a $B_1$—$B_1$ of FIG. 1A is shown by FIG. 1B, and a front diagram of the magnetic path plate 27 is shown in FIG. 1C.

In the above embodiment of an electromagnetic switch, when the movable core 9 sucked to the side of the fixed core 6 is retracted, the rear end portion thereof contacts and is received by the receiving portion 23*c*. Since the receiving portion 23*c* is made of a synthetic resin material, no metallic sound is generated and the contact sound is small. Furthermore, the movable core 9 is received by the receiving portion 23*c* in a large contact area thereby preventing the wear on the both sides. Moreover, the arms 23*b* and the receiving portion 23*c* are formed integrally with the bobbin 23, and can easily be manufactured in use of a synthetic resin forming.

Example 2

Figure 3A:
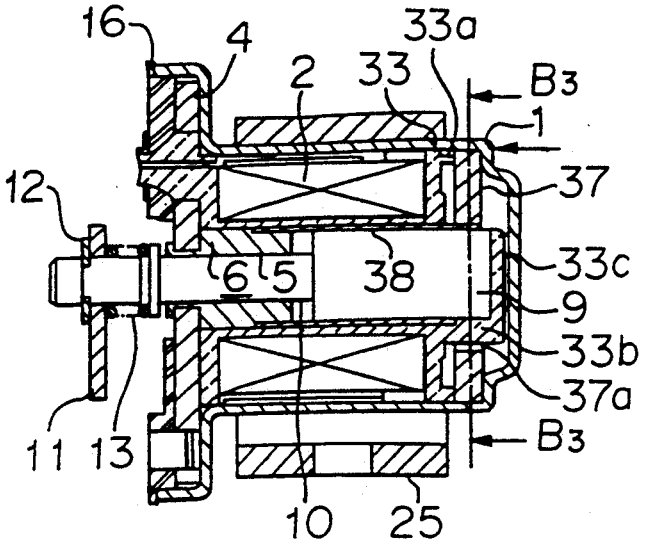
FIGS. 3A, 3B and 3C illustrate a second embodiment of an electromagnetic switch according to the present invention, wherein FIG. 3A designates a longitudinal sectional diagram of an important part thereof, FIG. 3B, a sectional diagram taken along a line $B_3$—$B_3$ of FIG. 3A and FIG. 3C, a front view of a magnetic path plate of FIG. 3A.
Figure 3B:
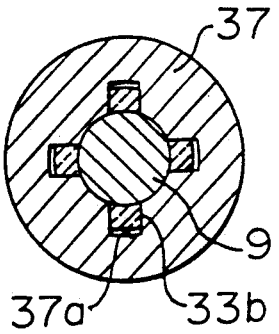
Figure 3C:
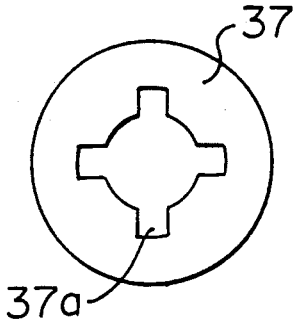

FIG. 3A illustrates a sectional diagram of an important part showing a second embodiment of an electromagnetic switch according to the present invention. A plurality (4 in FIG. 3A) of thick-walled arms 33*b* are extended in the axial direction from an inner peripheral portion of a flange portion 33*a* on the other side of the bobbin 33 made of a synthetic resin material, at the respective end portions of which a circular receiving portion 33*c* is integrally formed therewith, which receives the retracted movable core 9. A numeral 37 designates a circular magnetic path plate contacting an outer end of the flange 33*a* on the other side of the bobbin 33, and fixed to an inner rear end of the yoke 1, the inner periphery of which opposes the outer periphery of the movable core 9 by a small air gap. In this way, a magnetic resistance therebetween is reduced. A numeral 38 designates a bush made of a nonmagnetic material, which is fixed to the inner periphery of the bobbin 33. The respective arms 33*b* pass through cut-off portions 37*a* of the magnetic path plate 37. The construction on the front portion side of the embodiment wherein the illustration is omitted, is the same with that in FIG. 1A. A section thereof taken along a line $B_3$—$B_3$ of FIG. 3A is shown in FIG. 3B, and the magnetic path plate 37 is shown in FIG. 3C by a front view.

Example 3

Figure 4A:
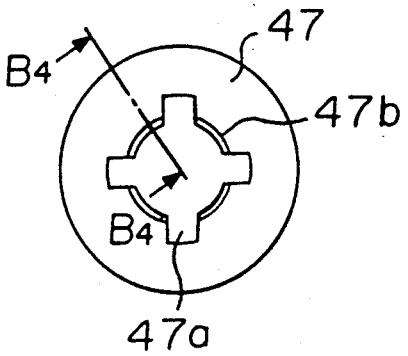
FIGS. 4A and 4B designate a third embodiment of a magnetic path plate according to the present invention, wherein FIG. 4A designates a front view thereof and FIG. 4B, a sectional diagram taken along a line $B_4$—$B_4$ of FIG. 4A.
Figure 4B:
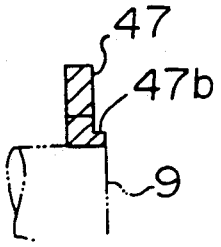

FIGS. 4A and 4B designate respectively a front view and a side sectional view of a magnetic path plate showing a third embodiment of this invention. A plurality of cut-off portions 47*a* are provided at an inner periphery of a circular magnetic path plate 47, and a protrusion 47*b* is formed outwardly in the axial direction by press-punching. In this way, a surface area thereof opposing the movable core 9 is increased, the magnetic resistance at the air gap is reduced and the ampere-turn of the excitation coil 2 can be reduced.

As stated above, according to the present invention, a plurality of thick-walled arms are extended outwardly in the axial direction from the inner peripheral portion of the other end portion of the bobbin for the excitation coil, the receiving portion is integrally formed with the ends of the respective arms, and the cut-off portions for passing through the respective arms of the bobbin are provided at the inner peripheral portion of the magnetic path plate contacting the flange on the other side of the bobbin. Accordingly, the impact receiving sound of the retracted movable core is reduced. Furthermore, the wear due to the contact-receiving of the receiving portion by the retracted movable core, is almost eliminated thereby extending the service life thereof. Furthermore, the manufacturing of the receiving portion of the bobbin can easily be performed.

Obviously, numerous modifications and variations of the present invention are possible in light of the above teachings. It is therefore to be understood that within the scope of the appended claims, the invention may be practiced otherwise than as specifically described herein.

What is claimed is:

1. An electromagnetic switch comprising:

an excitation coil wound around a bobbin made of a synthetic resin material;

a yoke accommodating said excitation coil;

a fixed core fixed inside of a first end side of said yoke;

a magnetic path plate contacting an outer end of a flange at a second end side opposite to said first end side of said bobbin and fixed inside of said second end side of the yoke;

a bush made of a nonmagnetic material and fixed in an inner periphery of the bobbin;

a movable core movably supported in said bush in the axial direction thereof; and terminal means closed by urging to press said terminal means by a magnetic suction of said movable core to said fixed core; wherein a plurality of arms are extended in the axial direction from an inner peripheral portion of the bobbin at the second end side thereof;

a receiving portion is formed at end portions of said respective arms integrally therewith;

cut-off portions are provided for passing the respective arms therethrough at an inner peripheral portion of said magnetic path plate; and the retracted movable core is received by an inner end face of said receiving portion.

* * * * *